United States Patent [19]

Petter

[11] Patent Number: 4,880,118

[45] Date of Patent: Nov. 14, 1989

[54] STABILIZER FOR STACKABLE AND FOLDABLE WIRE CONTAINERS

[75] Inventor: Jay C. Petter, Pentwater, Mich.

[73] Assignee: Pentwater Wire Products, Inc., Pentwater, Mich.

[21] Appl. No.: 303,138

[22] Filed: Jan. 30, 1989

[51] Int. Cl.[4] ..... B65D 21/02; B65D 6/08

[52] U.S. Cl. ..... 206/513; 206/511; 220/19

[58] Field of Search ..... 206/511, 512, 513; 220/19

[56] References Cited

U.S. PATENT DOCUMENTS

| | | | |
|---|---|---|---|
| 2,576,671 | 11/1951 | Coit | 206/513 |
| 2,576,672 | 11/1951 | Coit | 220/19 |
| 3,442,231 | 5/1969 | Jurasek | 206/513 |
| 3,812,999 | 5/1974 | Joseph | 206/513 |
| 3,979,006 | 9/1976 | Jurasek | 220/19 |
| 4,106,626 | 8/1978 | Trubiuno | 206/513 |

*Primary Examiner*—George E. Lowrance

*Attorney, Agent, or Firm*—Price, Heneveld, Cooper, DeWitt & Litton

[57] ABSTRACT

An improvement to portable industrial type foldable parts containers having welded mesh sides and upwardly recessed feet, one adjacent to but spaced from each of the corners of the container, including an upstanding stop welded to the top of each of a pair of parallel sides at a spacing such that the feet of a like container stacked on the container will fit between the stops to prevent sliding movement of the feet of the upper container off the sides of the container below. Another set of stops are secured one to each of the feet of the container above, which stops extend to overlap the stops on the container below to prevent displacement of the upper container toward and away from the sides mounting the first stops to permit transport of the containers in vertically stacked columns.

2 Claims, 2 Drawing Sheets

STABILIZER FOR STACKABLE AND FOLDABLE WIRE CONTAINERS

FIELD OF THE INVENTION

A returnable, wire mesh container is made capable of shipment in stacked columns by interengaging means at each of its corners which engages the container beneath to prevent horizontal displacement of the containers in the vertical column.

BACKGROUND OF THE INVENTION

Wire mesh containers have long been used in industrial facilities for transporting and temporary storage of in-process products such as gears, bearings, stamped parts and the like. These are normally moved around one or two at a time by floor trucks or forklifts. They may be stacked when used for temporary storage. They are provided with feet designed to facilitate stacking and to provide stable vertical columns of the containers. Many of these containers are designed to be foldable for storage when not in use. They are also used, while stacked, for transport between plants. When so used they are subject to horizontal displacement where the container may become unstacked and damage its contacts when the vehicle passes over a rough surface or makes an abrupt change in direction. This invention addresses this problem and makes such containers transportable over long distances under normal transport conditions while arranged in tiers or vertical columns.

BRIEF DESCRIPTION OF THE INVENTION

At each of the corners, a stop is mounted between the top wires of the container in a position to engage the adjacent foot of the container above and prevent movement of the upper container lengthwise of the side on which the stop is mounted. Secured to each of the feet of the container above is another stop positioned to engage the stop on the container below to prevent movement of the upper container in a direction normal to that prevented by the stop on the container below.

DESCRIPTION OF THE PREFERRED EMBODIMENT

Figure 1:
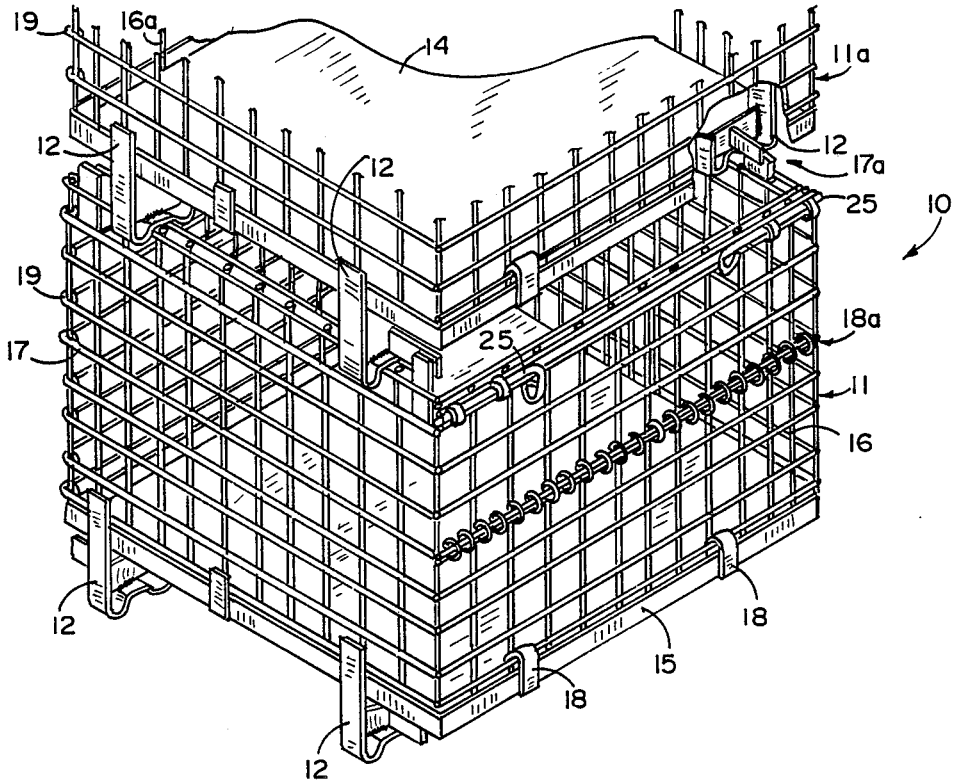
FIG. 1 is a fragmentary oblique view of a pair of stacked containers equipped with the invention.
Figure 3:
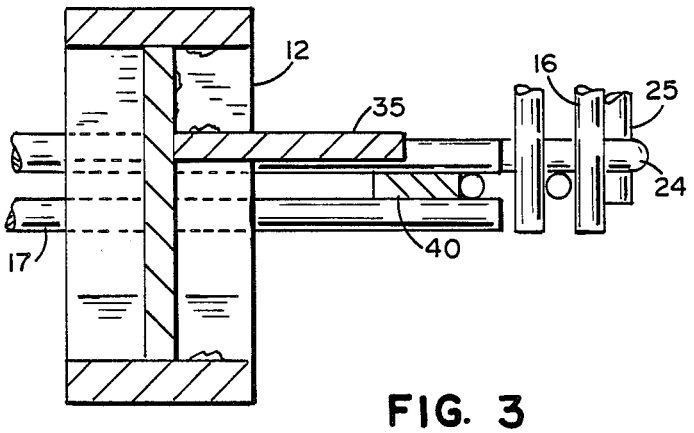
FIG. 3 is a sectional view taken along the plane III—III of FIG. 2.
Figure 2:
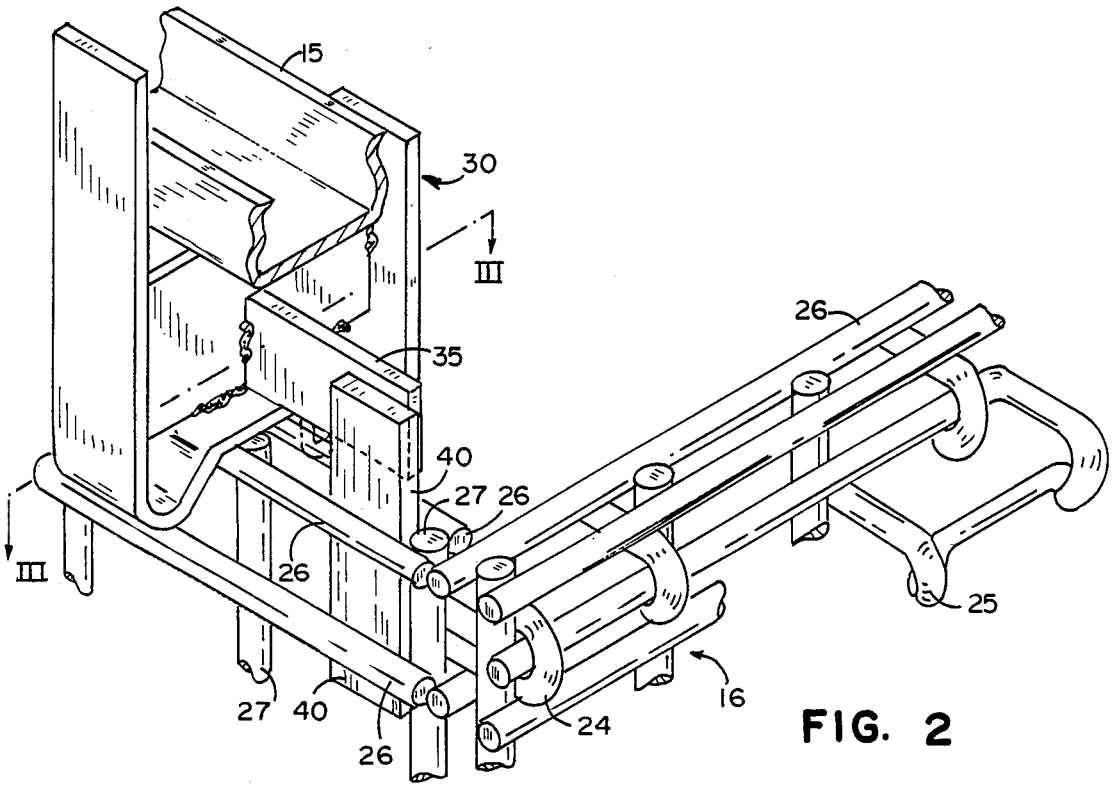
FIG. 2 is an enlarged, fragmentary, oblique view of the engagement, at one corner, of two stacked containers equipped with the invention.
Figure 4:
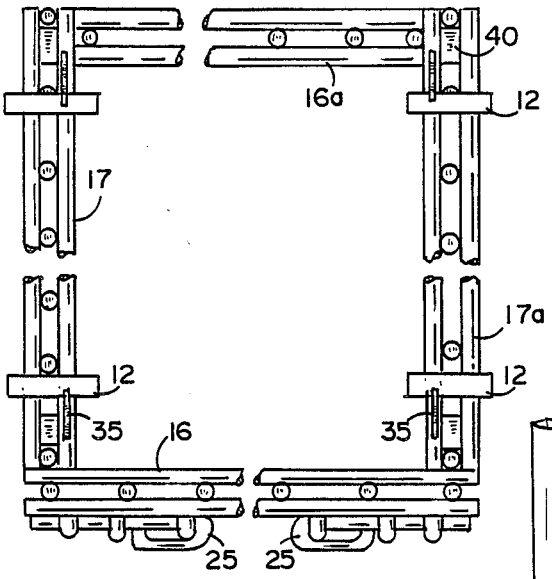
FIG. 4 is a broken plan view of the top of a container equipped with this invention.
Figure 5:
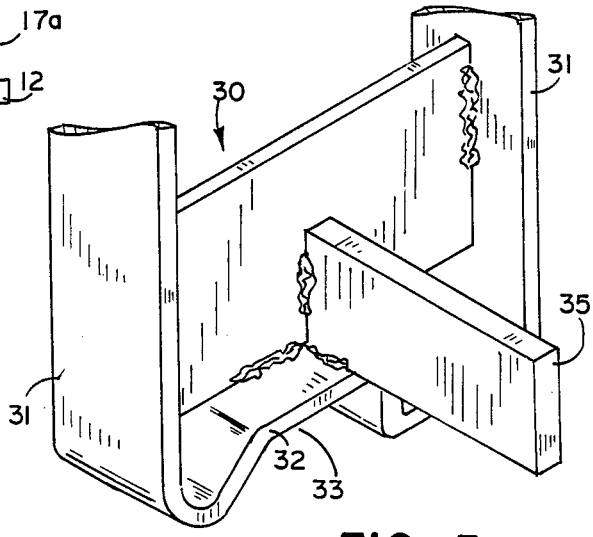
FIG. 5 is an enlarged fragmentary, oblique view of a support member equipped with this invention.

Referring to FIG. 1, numeral 10 identifies a vertical column consisting of containers 11 stacked one upon another and showing the engagement of the feet 12 of the upper container 11*a* upon the container 11 below. Each container consists of a bottom 14 which may be a panel of wire mesh or a solid panel in either case surrounded by frame 15. The four side panels include two end panels 16 and 16*a* which are hinged to fold down halfway and front and back panels 17 and 17*a* (FIG. 4). These panels may be almost identical in size or the end panels may be longer or shorter than the front and back panels. Preferably, the containers are square. The invention is equally applicable to either type. In the particular construction illustrated, the end panel 16 is designed to be capable of being folded outwardly of the container about the helical coil 18*a* to empty the container. It can also be folded inwardly when the front and back panels are pivoted outwardly enough to allow the end panel to pass between them. The other panels are hinged together at their ends as at 19 with the panel 16*a* hinged to the bottom panel in a manner similar to the panel 16. Thus, these three panels can be folded together and laid flat on the bottom 14 for storage or return shipment. All of this structure is conventional and well-known. In the container illustrated, the front and back panels are identical and at each end have a loop 24 designed to be engaged by a slidable latch 25 mounted on the adjacent end panel (FIGS. 2 and 3). Thus, the four panels are held in erected position by engagement of the latches when the panels are in use. All of the panels are manufactured of heavy wire or rod arranged as a grid and welded together at each of the intersections where the horizontals and verticals cross each other. Such containers can be used to transport heavy items, such as castings, and withstand both the vertical and the lateral pressures such contents exert upon the vertical panels as well as upon the bottom panel. The tops of these panels are normally formed by parallel spaced rods 26 extending horizontally with the vertical rods 27 seated between them and welded to both of the horizontals. Again, this is conventional construction for this type of container.

The containers are supported on somewhat U-shaped feet 30 which have upwardly extending legs 31, the upper ends of which are welded to the bottom panel 14 and the frame 15. The bottoms of the legs 31 are joined by an end portion 32, the center of which is offset upwardly to provide a recess 33. The recesses are substantially longer than the width of the front and back panels on which the feet are designed to rest. Therefore, a certain degree of misalignment of the containers in the vertical stack is possible. Further, since the front and back portions of the feet extend well below the top of the recess 33, the feet, by engagement with the front or back panels, will prevent lateral displacement of the feet and, therefore, the upper container with respect to the container on which it is resting. This arrangement provides a stable support for the containers when they are stacked in a storage facility. Under such circumstances, the containers once placed by suitable equipment, such as a forklift, will form a stable and dependable, vertical column. However, the engagement between the feet of the container above with the top of the container below is not sufficiently positive to assure stability of the vertical column when the containers are stacked in a vehicle such as a truck or a freight car where they are not only subject to vibration but also to lateral motion arising from any one of a number of causes including irregularities in the road bed or travelling around corners, particularly at higher speeds. It is because of this that it is necessary to provide further stabilization for the columns of stacked containers during transport. For this purpose, a stop 40 is welded to each end of each of the front and back panels. This can be easily done by making the stop 40 with a thickness which will permit it to be seated between the two top horizontal rods 26 immediately adjacent the end vertical 27. The stop extends down far enough so that it can be secured to the next adjacent horizontal rod 26 (FIG. 2). The stop is then welded to all of the rods so that it becomes a fixed part of the panel. The stop preferably extends one to two inches above the top of the front and back panels where it will provide a positive limit to movement of the adjacent foot of the upper container off the panel end of the panel on which it is supported. Thus, the provision of the four stops will positively prevent displacement of the upper container lengthwise of the panels 17 and 17*a*.

To prevent the containers from being displaced by forces great enough to cause them to ride up and over the top of the front and back panels on which they are supported, a secondary stop 35 is provided at each of the corners. This stop is located above the notch or recess 33 in the lower face of the leg. The secondary stops are welded to the feet 30 of the upper container and extend laterally from the feet and are of such length that they will, at all times, overlap the adjacent stop 40 (FIG. 3). The secondary stops will positively prevent accidental displacement of the upper container lengthwise of the panels 16 and 16*a*. Thus, complete stabilization of the column is provided, even under very adverse transport conditions.

It is important to this construction that both feet have a clearance of at least one inch from the adjacent stop 40 when the upper container is centered over the one below. This is necessary to eliminate interference from the stops during container stacking. If additional clearance space is provided, the stops 35 must be lengthened because they must provide engagement with all of the stops 40 when the containers are stacked. It is also important that the clearance between the first and second stops be in the order of one to one and a half inches before contact is made. Again, this is important to permit the containers to be stacked with a reasonable degree of care without interference between the stops during the placing of the upper container on the lower container. The containers, when loaded, can be very heavy and are placed by use of equipment, such as fork-lift trucks. While these can be maneuvered with a substantial degree of accuracy, the circumstances under which these types of containers are stacked frequently does not afford the operator the ability to precisely observe the vertical alignment of the containers with each other during stacking. Thus, a certain amount of play is essential if the operator is to complete his work without the necessity for excessive manipulation of his equipment of the presence of another person to observe the operation and advise the operator. Further, it is very important that the stops not interfere with each other such that the upper container becomes misaligned at one or more of its corners and, thereby, is not level creating a distortion in the column. This could also create an unstable column.

It is also important to the design of these stops that neither the primary nor the secondary stop interfere in any way with the folding of the panels of the container when the container is prepared for storage or for return shipment. Furthermore, they must remain within the silhouette of the bottom of the container and, therefore, do not project beyond it to create a structure which would snag or otherwise interfere with adjacent stored containers.

The invention provides a solution to the stabilization of vertical columns of stacked containers of this type which is not only simple and inexpensive but also may be applied to existing containers because it does not require any of the structure of the existing containers to be modified to effect installation of the stops. Also, in the manufacturing process, the stops can be added to containers as required without necessitating modification of the basic container in the manufacturing process. These are important cost factors which further add to the desirability of the invention.

Having described the preferred embodiment of the invention, it will be recognized that modifications of the invention can be made without departing from the principles of the invention. Such modifications are to be considered as included in the hereinafter appended claims, unless these claims, by their language, expressly state otherwise.

I claim:

1. A rectangular shipping container having vertical panels fabricated of rods welded to form a mesh and a bottom panel, said container having a depending support member spaced a short distance from each of its corners, said members being rigidly secured to said container, each of said support members having an upwardly recessed lower surface forming a pocket to seat over and receive the top edge of a like container beneath it, the improvement in said container comprising: a pair of upstanding stops rigidly secured to each of a pair of opposite sides of said container, one at each end of each of said sides; each stop being located in vertical alignment with the space between the end of the panel and the support member depending therefrom of a like container seated said container whereby it will extend upwardly between the support member and the adjacent end of said like container stacked thereon to prevent movement of the container above lengthwise of the sides to which the stops are secured; a second stop rigidly secured to the support members adjacent each of the corners of the container above and extending toward the adjacent corner of the container a distance such that each will overlap the upwardly projecting first stops of the container below to prevent displacement of said container in a direction normal to the plane of the sides on which the container is supported.

2. Means for preventing horizontal displacement of one container with respect to the other of a pair of vertically stacked containers, said means being provided adjacent each of the corners of the containers, said containers having a depending support member adjacent each of its corners, said support members being arranged in pairs on opposite sides of the container and spaced from the corners to which they are adjacent, the bottoms of said support members being recessed to fit over the like sides of a container below, said means comprising: an upwardly projecting first stop rigidly attached to each of said sides at each of its upper corners, said stops being spaced apart sufficiently to receive between them the support members of a like container stacked on and above said one container, a second stop mounted on each of said support members and extending from its support member parallel to said first stop sufficiently to overlap the first stop of a like container on which said one container is stacked, said stops in combination limiting relative displacement in any horizontal direction of said one container with respect to a like container on which it is supported.

* * * * *